US007938291B2

(12) United States Patent
Christensen

(10) Patent No.: US 7,938,291 B2
(45) Date of Patent: May 10, 2011

(54) FOLDABLE WATER TANK WITH SHIELDED HINGES

(75) Inventor: Jan Christensen, Rock Island, IL (US)

(73) Assignee: Eldred Corporation, Milan, IL (US)

( * ) Notice: Subject to any disclaimer, the term of this patent is extended or adjusted under 35 U.S.C. 154(b) by 697 days.

(21) Appl. No.: 11/716,664

(22) Filed: Mar. 12, 2007

(65) Prior Publication Data

US 2008/0223863 A1 Sep. 18, 2008

(51) Int. Cl.
*B65D 6/18* (2006.01)

(52) U.S. Cl. ..... 220/666; 220/4.28

(58) Field of Classification Search ..... 220/4.16, 220/4.12, 4.34, 4.33, 9.3, 9.2, 9.1, 23.86, 220/666, 495.06, 1.6, 4.01, 4.13, 495.01, 220/FOR. 122, FOR. 120, FOR. 115, FOR. 112; 206/600, 386; 4/587, 586, 585, 584; 16/386, 16/364, 362, 361, 257, 250, 251, 319, 346, 16/348, 349, 352, 365, 387
See application file for complete search history.

(56) References Cited

U.S. PATENT DOCUMENTS

| | | | | | |
|---|---|---|---|---|---|
| 314,752 | A | * | 3/1885 | Throckmorton | 4/587 |
| 858,488 | A | * | 7/1907 | Tynes | 220/9.2 |
| 1,125,100 | A | * | 1/1915 | Hoover | 220/495 |
| 1,135,892 | A | * | 4/1915 | Grosenbeck | 220/9.3 |
| 1,181,829 | A | * | 5/1916 | Bower | 220/9.3 |
| 1,307,942 | A | | 6/1919 | Volters | |
| 1,738,017 | A | | 12/1919 | Phillips | |
| 1,444,487 | A | * | 2/1923 | Volters | 4/587 |
| 1,533,636 | A | | 4/1925 | Day | |
| 2,628,364 | A | * | 2/1953 | Wallace et al. | 4/494 |
| 2,749,956 | A | | 6/1956 | Eldred | |
| 3,603,541 | A | | 9/1971 | Sturm et al. | |
| 3,881,221 | A | * | 5/1975 | Schmidt | 16/366 |
| 4,356,593 | A | * | 11/1982 | Heininger et al. | 16/251 |
| 4,356,933 | A | | 11/1982 | Connolly | |
| 4,649,947 | A | | 3/1987 | Tury et al. | |
| 5,353,451 | A | * | 10/1994 | Hsiung | 5/99.1 |
| 5,485,655 | A | * | 1/1996 | Wang | 16/371 |
| 5,530,977 | A | * | 7/1996 | Wang | 5/99.1 |
| 5,730,542 | A | * | 3/1998 | Cheng | 403/102 |
| 5,803,650 | A | | 9/1998 | Wu | |
| 6,276,548 | B1 | * | 8/2001 | Mitchell | 220/9.4 |
| 6,516,965 | B1 | * | 2/2003 | Perkins | 220/9.4 |
| 7,036,676 | B2 | | 5/2006 | Christensen | |

* cited by examiner

*Primary Examiner* — Anthony Stashick
*Assistant Examiner* — Robert J Hicks
(74) *Attorney, Agent, or Firm* — Shlesinger, Arkwright & Garvey LLP

(57) ABSTRACT

A foldable water tank includes a foldable receptacle having a bottom wall and vertical sidewalls; and a folding frame to support the sidewalls in an upright position. The frame has first, second, third and fourth upper rails joined end-to-end. The frame has a folded position wherein the upper rails are adjacent to each other. First hinges disposed at end portions of said upper rails pivotably connect the upper rails. The second and fourth rails each includes first and second sections having adjacent end portions. Second hinges connect the adjacent end portions to allow the second and fourth rails to fold inwardly to be disposed between the first and third rails in the folded position. The second hinges each includes a shield to cover the adjacent end portions thereby to protect a user's hand from being pinched by the adjacent end portions during unfolding or folding of the frame.

13 Claims, 7 Drawing Sheets

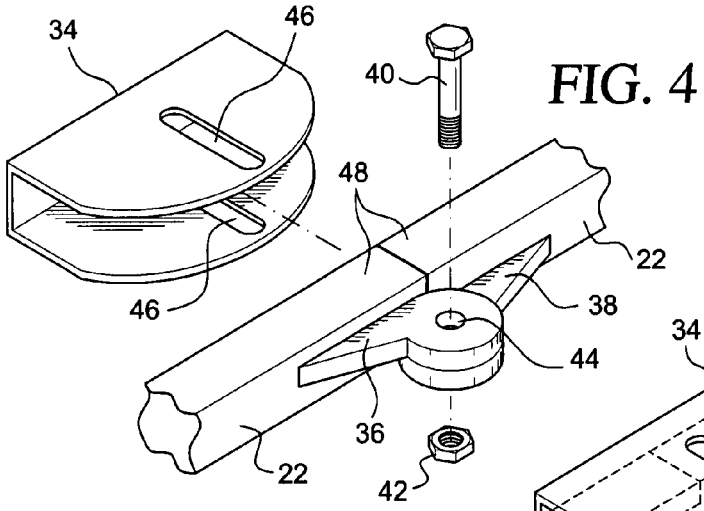
FIG. 4
FIG. 5
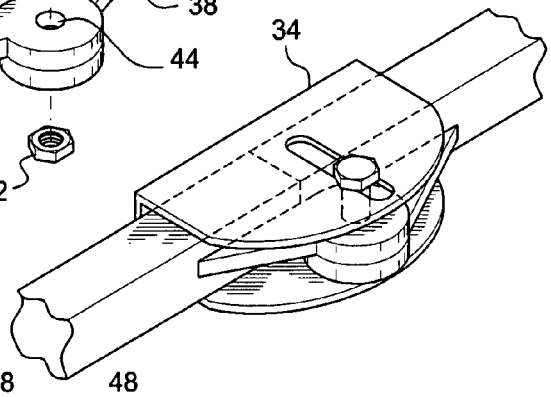
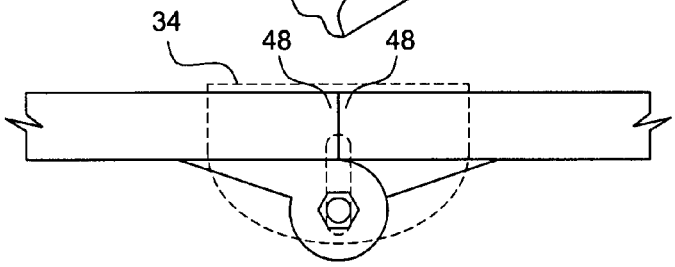
FIG. 6
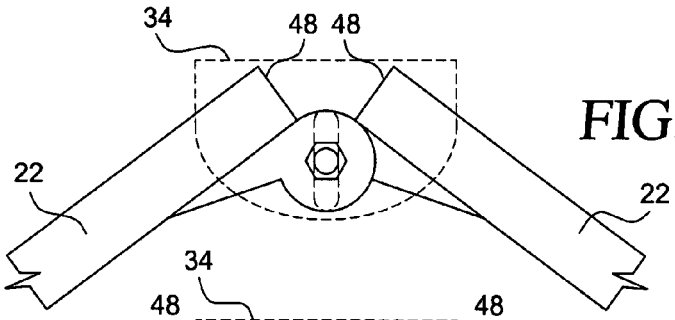
FIG. 7
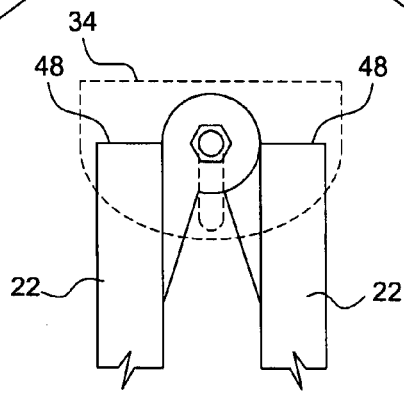
FIG. 8

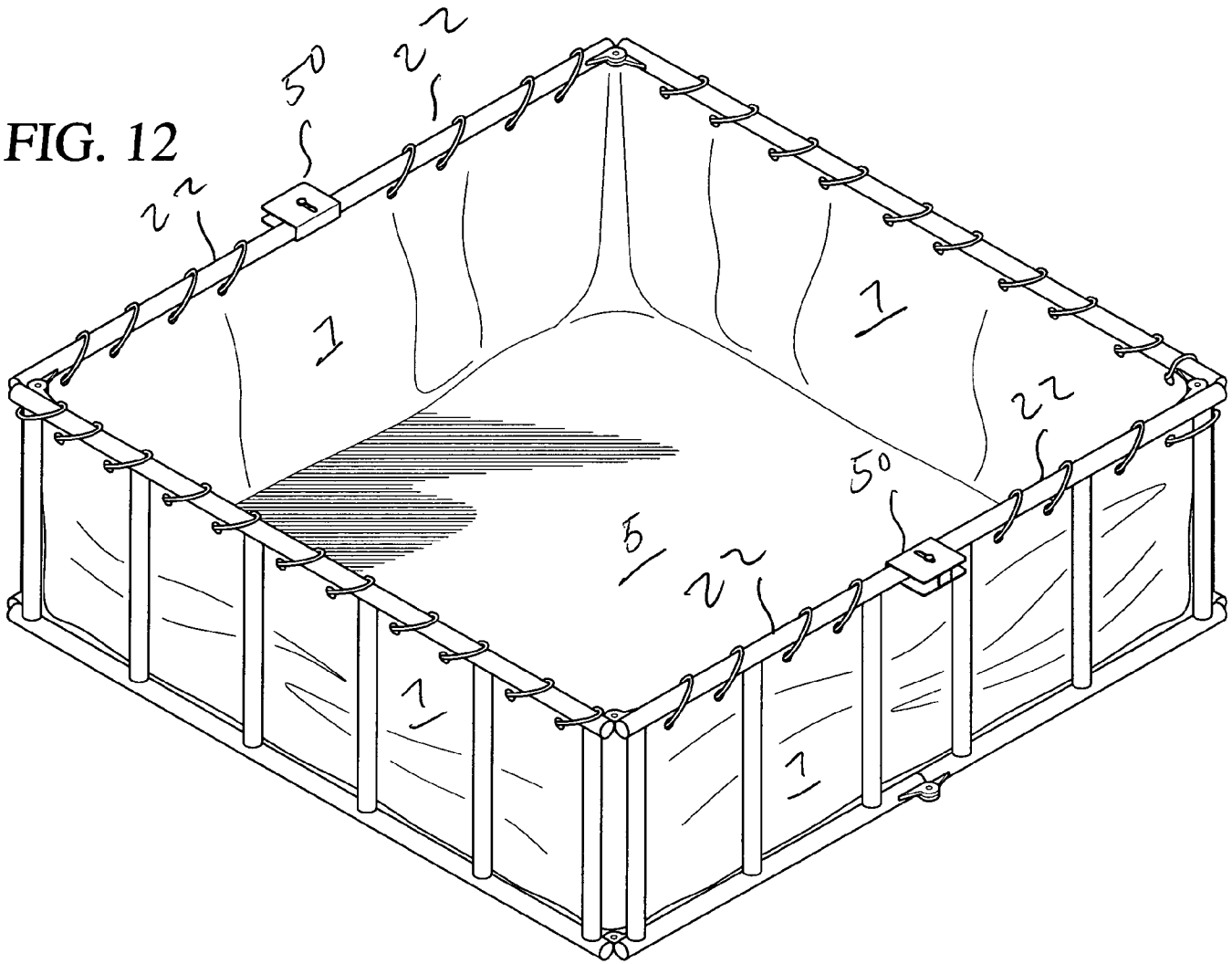
22
22
22

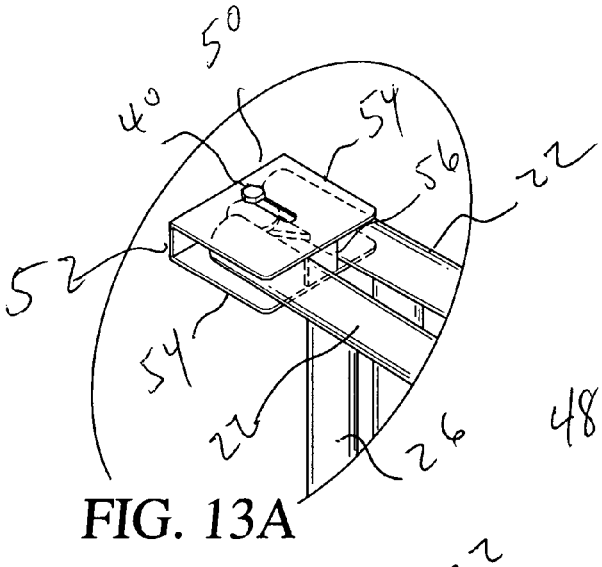
FIG. 13A
FIG. 13B
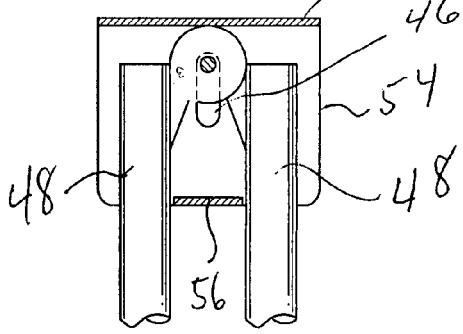
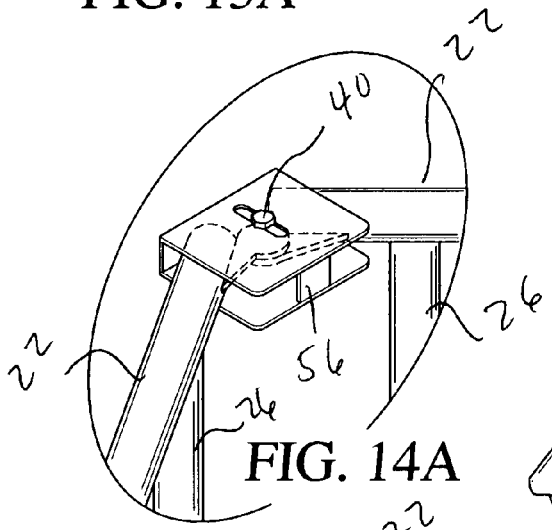
FIG. 14A
FIG. 14B
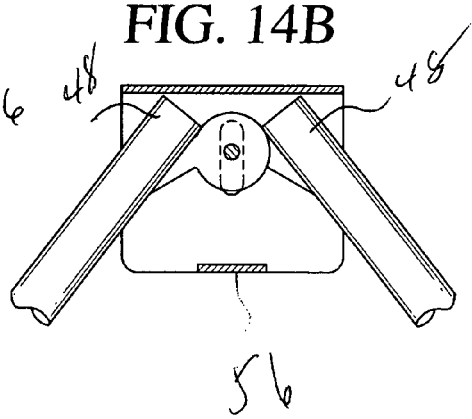
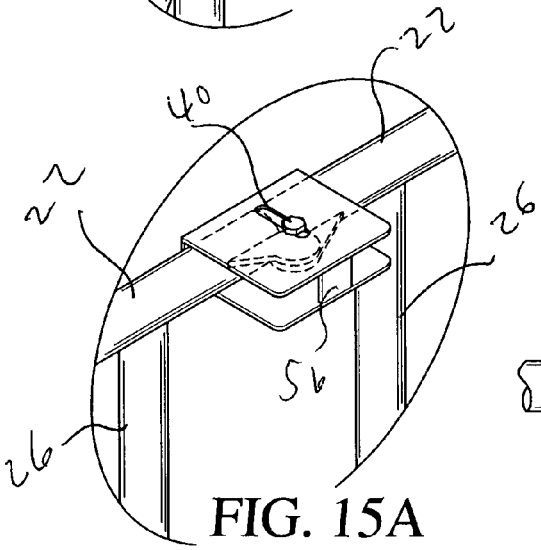
FIG. 15A
FIG. 15B
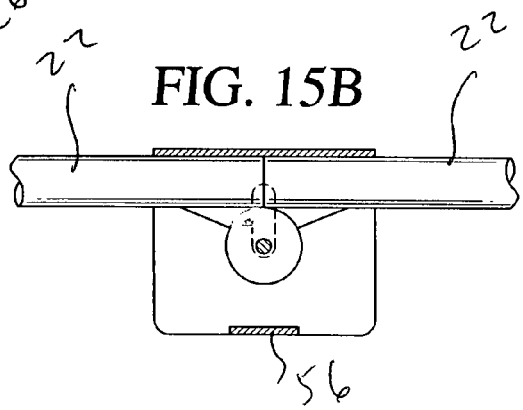

FOLDABLE WATER TANK WITH SHIELDED HINGES

FIELD OF THE INVENTION

The present invention is directed generally to a foldable water tank and specifically to a foldable water tank having a foldable frame that folds substantially flat for storage and transport.

OBJECTS AND SUMMARY OF THE INVENTION

It is an object of the present invention to provide a folding water tank that folds substantially flat for storage and transport while minimizing the risk of injury to the user's hands when unfolding or folding.

It is another object of the present invention to provide a folding water tank that allows placement of the user's hand over the hinges for maximum application of force during folding and unfolding of the tank while minimizing the risk of injury to the user's hands.

In summary, the present invention provides a foldable water tank, comprising a foldable receptacle having a bottom wall and vertical sidewalls; and a folding frame to support the sidewalls in an upright position. The frame has first, second, third and fourth upper rails joined end-to-end to form an enclosure in an unfolded position. The frame has a folded position wherein the upper rails are adjacent to each other. First hinges disposed at end portions of said upper rails pivotably connect the upper rails to form the enclosure at the unfolded position. The first and second upper rails are opposite to each other, and the second and fourth upper rails are opposite to each other. The second and fourth rails each includes first and second sections having adjacent end portions. Second hinges connect the adjacent end portions to allow the second and fourth rails to fold inwardly to be disposed between the first and third rails in the folded position. The second hinges each includes a shield to cover the adjacent end portions thereby to protect a user's hand from being pinched by the adjacent end portions during unfolding or folding of the frame.

These and other objects of the present invention will become apparent from the following detailed description.

BRIEF DESCRIPTION OF THE DRAWINGS

FIG. 4 is an assembly view of a hinge used in the folding frame of FIG. 2.

FIG. 5 is a perspective view of the hinge of FIG. 4, completely assembled.

FIGS. 6-8 show various positions of the hinge of FIG. 5 during the folding of the frame of FIG. 2.

FIG. 12 is the foldable water tank of FIG. 11, shown in the fully unfolded position.

FIG. 13A is an enlarged perspective view of a hinge showing an alternative embodiment of a hinge used in the present invention.

FIG. 13B is a plan view of FIG. 13A, with portions shown in cross-section.

FIG. 14A is similar to FIG. 13A, showing the hinge in a partly unfolded position.

FIG. 14B is a plan view of FIG. 14A, with portions shown in cross-section.

FIG. 15A is similar to FIG. 13A, showing the hinge in the fully unfolded position.

FIG. 15B is a plan of FIG. 15A, with portions shown in cross-section.

DETAILED DESCRIPTION OF THE INVENTION

Figure 1:
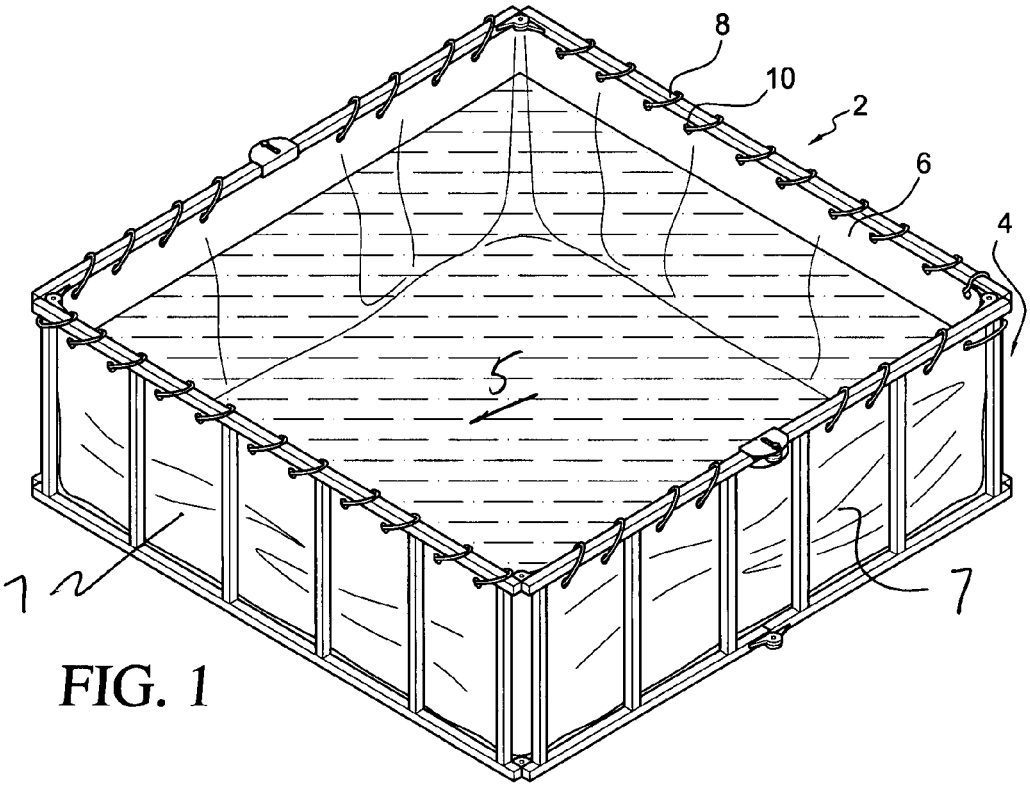
FIG. 1 is a perspective view of a foldable water tank made in accordance with the present invention.

A foldable water tank 2 made in accordance with the present invention is disclosed in FIG. 1. The tank 2 has a folding frame 4 and a flexible receptacle 6 made from conventional water-tight material. The receptacle 6 has a bottom wall 5 and vertical sidewalls 7 secured to the frame 4 with a rope 8 or similar material threaded through openings 10 along the upper edge portion of the receptacle 6 and spirally wound around the upper rails of the frame. The frame 4 forms a free-standing structure to provide support to the sidewalls 7 in the vertical position so as to keep the receptacle 6 in the open position ready to receive water. The tank 2 is shown filled with water to a level below the openings 10.

Figure 3:
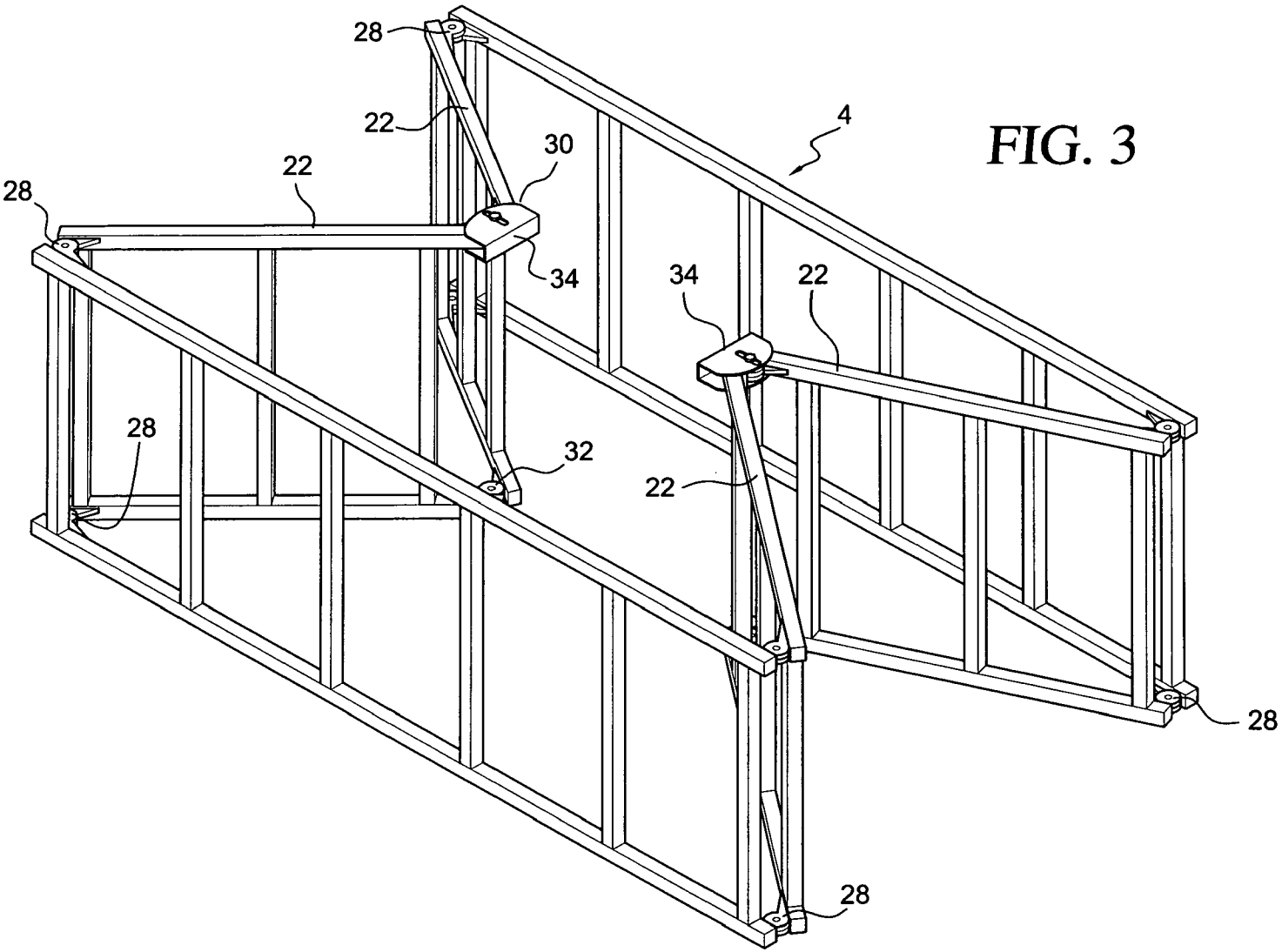
FIG. 3 is a perspective view of the frame of FIG. 2, shown partially folded.

The frame 4 is preferably 4-sided. The frame 4 has a pair of opposite sides 12 and another pair of opposite sides 14. Each side 12 includes an upper rail 16, a bottom rail 18 and a plurality of vertical posts 20 joining the bottom rail to the respective upper rail. Each of the sides 14 includes a pair of upper rails 22 and a pair of bottom rails 24. A plurality of posts 26 join the bottom rails to the respective upper rails. The frame 4 is preferably made from tubular members of any cross-sectional shape, such as square (see FIG. 3) or circular (see FIG. 11). The sides 12 are attached to the corresponding sides 14 with hinges 28 secured to the respective corners of the adjacent sides. Each of the sides 14 is made of two sections attached to each other with hinges 30 and 32. The hinges 28, 30 and 32 advantageously allow the frame 4 to be folded into a compact, substantially flat configuration, where the upper and bottom rails of the sides 12 and 14 are parallel to each other. FIG. 3 shows the frame 4 in a partially folded position (the receptacle 6 is not shown for clarity but should be understood that the receptacle remains attached to the frame as the frame is folded). The hinges advantageously allow the inward rotation of the sections 22 toward the respective sides 12 such that the tank 2 may be folded into a compact, substantially flat shape. The hinges advantageously allow rotation of the sides to accomplish the folding feature of the tank 2.

The hinges 32 are the same as the hinges 28. The hinges 30 each includes a U-shaped shield 34 to protect the user's hand in folding or unfolding the frame 4, as will be discussed below.

Figure 2:
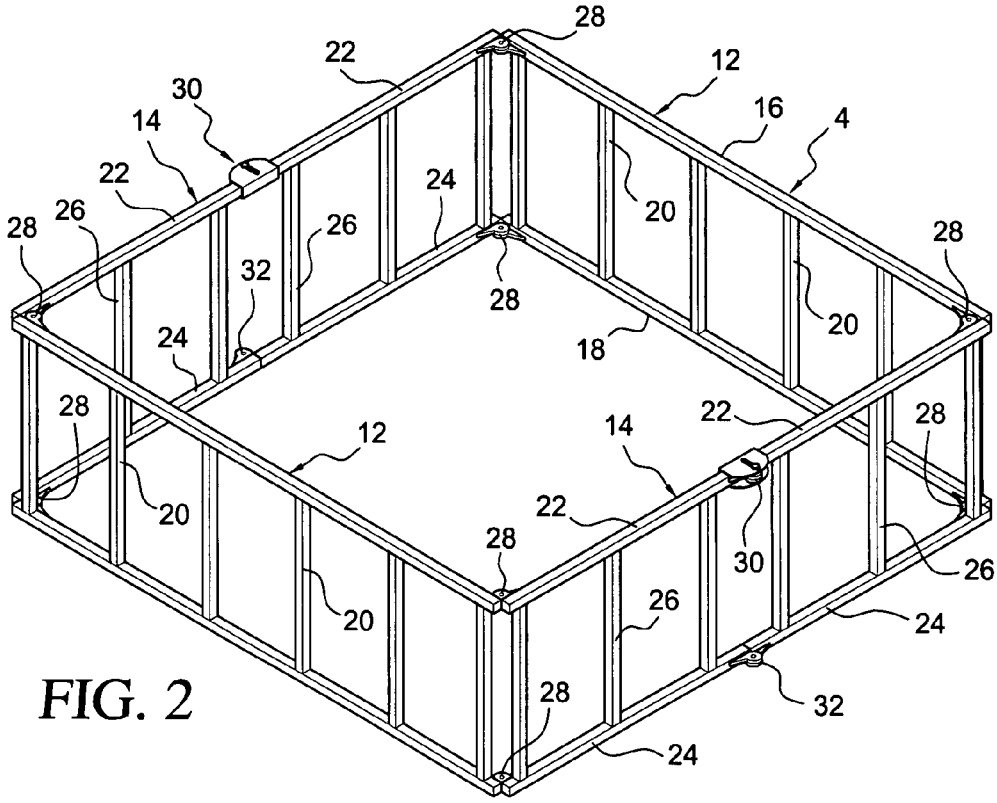
FIG. 2 is a perspective view of the frame of the foldable water tank of FIG. 1, shown without the receptacle for clarity.
Figure 9:
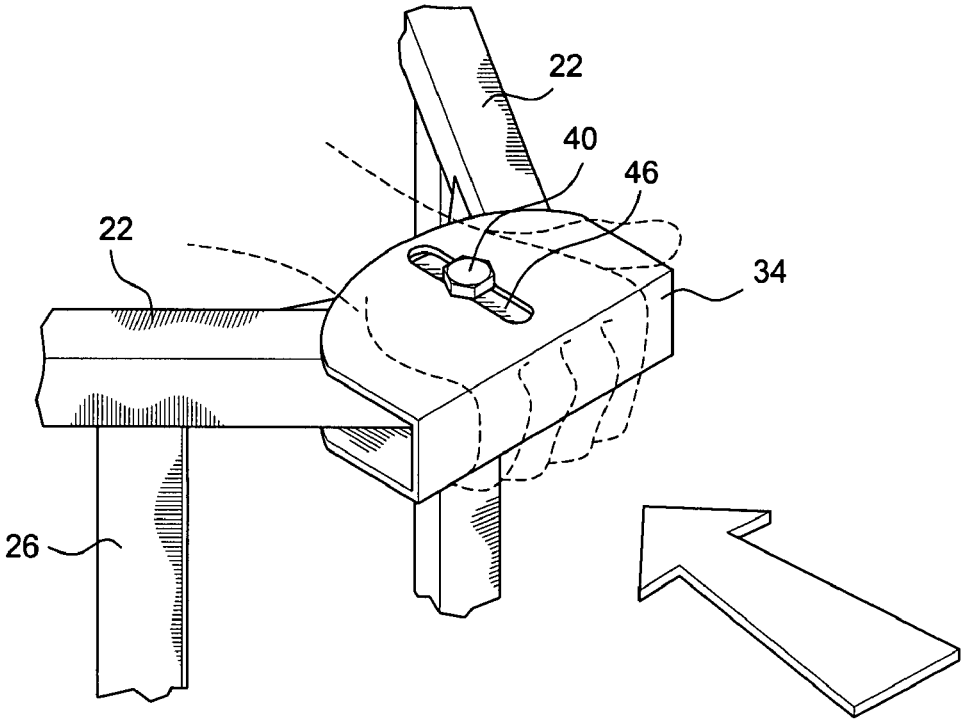
FIGS. 9 and 10 are perspective views of the hinge of FIG. 5, showing how the hand of a user is shielded from the pinching motion of the ends of the frame at the hinge during folding and unfolding of the tank.
Figure 10:
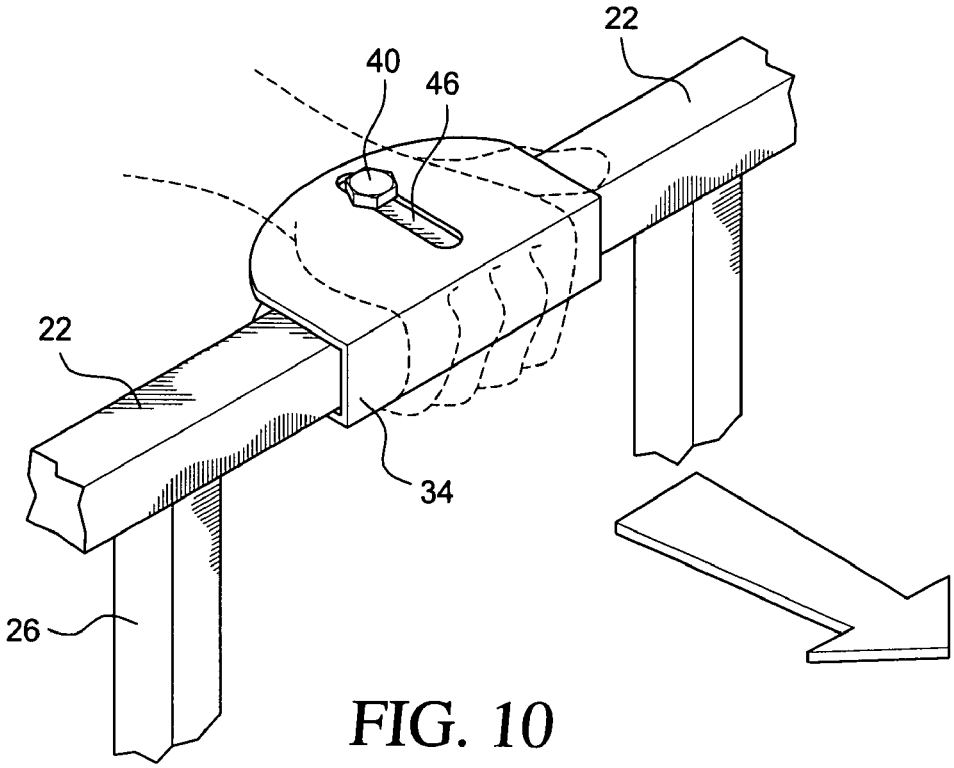

The hinge 30 includes members 36 and 38 attached to respective upper rails 22 and pivotably joined together with a bolt 40 and a nut 42 received in openings 44 in the respective members 36 and 38. The bolt 40 functions as the pivot pin for the hinge. The shield 34 is attached to the bolt 40 in a sliding manner along slots 46. The shield 34 is advantageously U-shaped to enclose the ends 48 of the upper rails 22. The shield 34 slides into or away from the bolt 40 along the slots 46, as shown in FIGS. 6, 7 and 8. The sliding motion of the shield 34 allows the pivoting of the upper rails 22 about the bolt 40 without exposing the user's hand to possible pinching by the ends 48 when unfolding the frame 4. As shown in FIGS. 9 and 10, the frame 4 is unfolded by grabbing the shield 34 and pulling on the shield to open the side 14 so that the rails 22 will line up, as best shown in FIG. 2. Without the shield 34, the ends 48 could pinch the user's hand or fingers. With the shield 34, the user's hand is advantageously protected from the possible pinching injury. Furthermore, the provision of the shield 34 advantageously provides a place where the user can safely grab the frame to exert a force to unfold or fold the tank 2 and have the force directed at the axis of rotation located about bolt 40 where it is most efficient.

To fold the frame 4, the shield 34 is grabbed by the user and pulled towards the center of the frame, rotating the sides 14 relative to the side 12 about the respective hinges, as best shown in FIG. 3. When fully folded, the upper and bottom rails of the sides will be substantially parallel to each other.

The hinges 28 and 32 are the same as the hinges 30 except for the inclusion of the shield 34 in the hinge 30.

Figure 11:
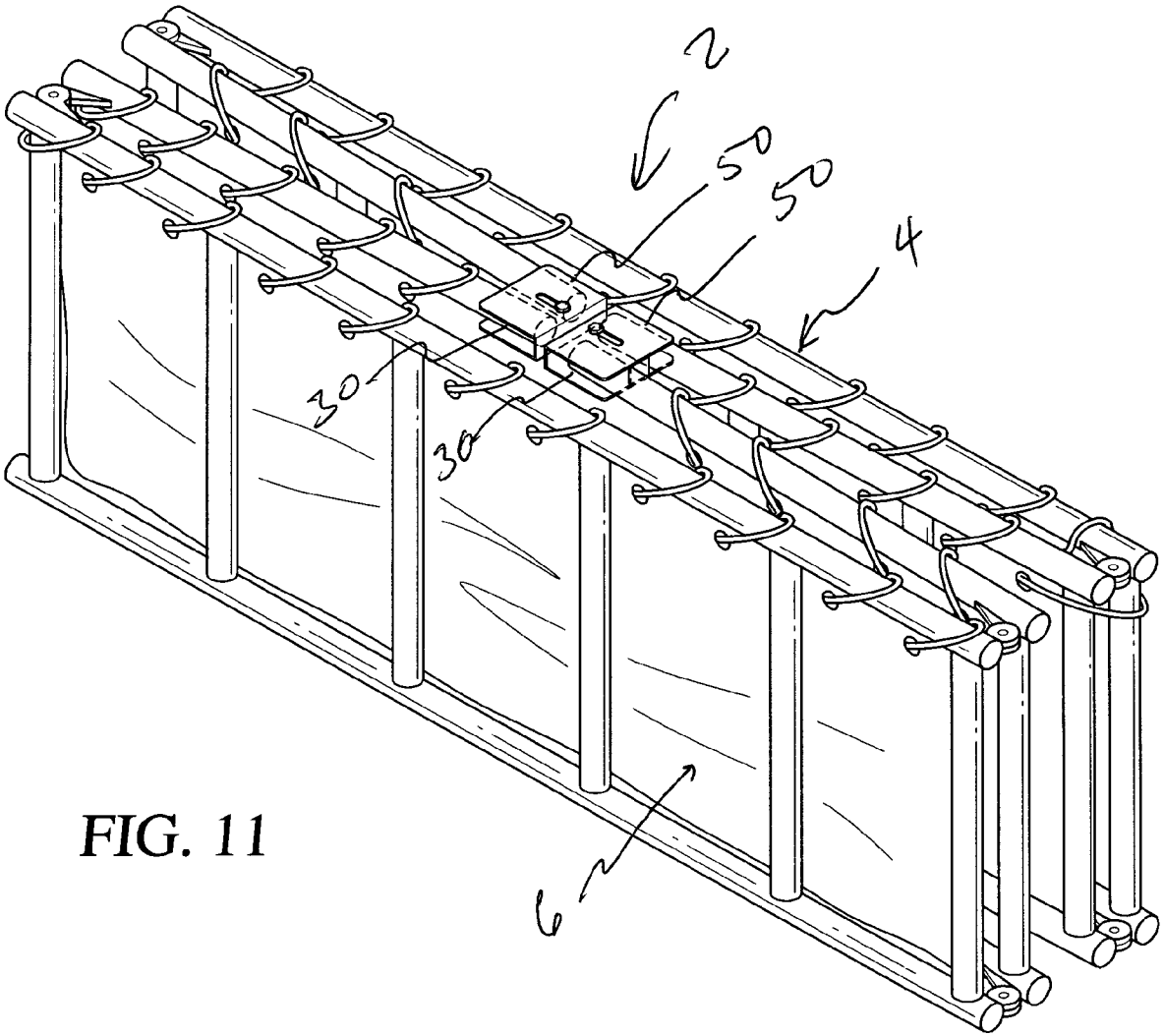
FIG. 11 is a perspective view of foldable water tank made in accordance with the present invention, shown in the folded position.

Referring to FIG. 11, the foldable water tank 2 is shown in the folded position including the frame 4 and the receptacle 6. The tank 2 of FIG. 11 uses an alternative embodiment of a shield 50 disposed over each of the upper hinges 30. The tank 2 of FIG. 11 is shown fully unfolded in FIG. 12.

The shield 50 is substantially U-shaped, with a base wall 52 and a pair of opposing side walls 54 joined at the base wall 52. The side walls 54 are joined at their distal edge portions by a connecting member 56 disposed centrally from one distal edge to the opposite distal edge. The member 56 acts as a stop when the frame is in the folded position 58. The member 56 further provides reinforcement to the opposing walls 54 to prevent an undue clamping action on the enclosed upper rail end portions of 48 when the bolt 40 is tightened during assembly.

While this invention has been described as having preferred design, it is understood that it is capable of further modification, uses and/or adaptations following in general the principle of the invention and including such departures from the present disclosure as come within known or customary practice in the art to which the invention pertains, and as may be applied to the essential features set forth, and fall within the scope of the invention or the limits of the appended claims.

I claim:

1. A foldable water tank, comprising:

a) a foldable receptacle having a bottom wall and vertical sidewalls;

b) a folding frame to support said sidewalls in an upright position;

c) said frame having first, second, third and fourth upper rails joined end-to-end to form an enclosure in an unfolded position, said frame having a folded position wherein said upper rails are adjacent to each other;

d) first hinges disposed at end portions of said upper rails pivotably connecting said upper rails to form said enclosure at said unfolded position;

e) said first and third upper rails are opposite to each other, said second and fourth upper rails are opposite to each other;

f) said second and fourth rails each including first and second sections having adjacent end portions;

g) second hinges each connecting respective said adjacent end portions to allow said second and fourth rails to fold inwardly to be disposed between said first and third rails in said folded position;

h) a plurality of shields each operably associated with respective said second hinges to cover respective said adjacent end portions thereby to protect a user's hand from being pinched by said adjacent end portions during unfolding or folding of said frame;

i) each of said second hinges including a pivot pin about which each of said adjacent end portions is pivotable; and j) each of said shields is secured to each respective said pivot pin.

2. A foldable water tank as in claim 1, wherein:

a) each of said shields includes a slot through which said pivot pin is disposed; and b) each of said shields is slidable over respective said second hinges through said slot.

3. A foldable water tank as in claim 1, wherein each of said shields is U-shaped.

4. A foldable water tank as in claim 3, wherein each of said shields includes a base wall and a pair of opposing walls joined at said base wall.

5. A foldable water tank as in claim 4, and further comprising a member joining said pair of opposing walls at their distal edge portions.

6. A foldable water tank as in claim 4, wherein said pair of opposing side walls are rectangular.

7. A foldable water tank as in claim 5, wherein said distal edge portions are curved.

8. A foldable water tank as in claim 1, wherein said upper rails are tubular.

9. A foldable water tank as in claim 8, wherein said upper rails are rectangular in cross-section.

10. A foldable water tank as in claim 8, wherein said upper rails are cylindrical in cross-section.

11. A. foldable water tank as in claim 1, wherein:

a) said frame includes bottom rails; and b) posts joining said upper rails to said bottom rails.

12. A foldable water tank as in claim 11, wherein said bottom rails are hingedly connected to one another.

13. A foldable water tank as in claim 1, wherein said sidewalls are attached to said upper rails.

* * * * *